US005984708A

United States Patent [19]

Yu

[11] Patent Number: 5,984,708

[45] Date of Patent: Nov. 16, 1999

[54] CARD EDGE CONNECTOR

[75] Inventor: Wang-I Yu, Taipei, Taiwan

[73] Assignee: Berg Technology, Inc., Reno, Nev.

[21] Appl. No.: 09/122,157

[22] Filed: Jul. 24, 1998

Related U.S. Application Data

[62] Division of application No. 08/672,580, Jun. 28, 1996, Pat. No. 5,791,925.

[51] Int. Cl.[6] ..... H01R 13/62

[52] U.S. Cl. ..... 439/326

[58] Field of Search ..... 439/325–328, 439/629–636

[56] References Cited

U.S. PATENT DOCUMENTS

| | | | |
|---|---|---|---|
| 5,203,714 | 4/1993 | Tuan | 439/326 |
| 5,413,497 | 5/1995 | Lwee | 439/328 |
| 5,484,302 | 1/1996 | Yamada et al. | 439/326 |
| 5,525,071 | 6/1996 | Obara et al. | 439/326 |
| 5,562,461 | 10/1996 | Obara et al. | 439/326 X |
| 5,641,295 | 6/1997 | Koyama | 439/326 |
| 5,779,494 | 7/1998 | Ito et al. | 439/326 |

*Primary Examiner*—Khiem Nguyen
*Attorney, Agent, or Firm*—Daniel J. Long; M. Richard Page

[57] ABSTRACT

Disclosed is a card edge connector which includes an insulative housing comprising a body and opposed perpendicular arms. The body of the housing has a card receiving side having a longitudinal groove. This groove has opposed lateral first and second sides and each of said first and second sides has at least one first and second contact receiving opening. There is also at least one recess in the card receiving side of the body communicating with said first aperture in the first lateral side of the groove. There is also at least one recess in the opposed side of the housing body communicating with the second opening in the groove. A first contact fixed in the recess in the card receiving side of the body and extends through said first opening into the groove. A second contact is fixed in the recess in said opposed side of the body and extends through said second aperture into the groove. An efficient means of mounting the contacts in the housing and for allowing engagement of a card with the housing is thus provided. Metal inserts are also provided adjacent the perpendicular arms of the housing to provide overstress protection and other advantages.

19 Claims, 8 Drawing Sheets

CARD EDGE CONNECTOR

This application is a division of application Ser. No. 08/672,580, filed Jun. 28, 1996 now U.S. Pat. No. 5,791,925.

BACKGROUND OF THE INVENTION

1. Field of the Invention

The present invention relates to electrical connectors and more particularly to card edge connectors.

2. Brief Description of Prior Developments

Edge connectors may be attached to printed circuit boards and may be used for connection of cards used for the retrieving or storage of information. Various card edge connectors are known in the art in which the front edge of a card is inserted in a longitudinal groove of a insulated housing. Adjacent that groove there are a plurality of contacts with arcuate conductive contacts arranged in side by side relation adjacent the groove so that conductive pads on the printed wiring board contact the arcuate sections of the contacts as the board is inserted into the groove. A continuing need exists for improved means for engaging the card with the contacts and for mounting the contacts in the insulative housing.

A need also exists in such card edge connectors for means for protecting the housing against excessive stresses, for providing a stop for the card, for providing a solderable hold down and for simplifying overall tooling.

SUMMARY OF THE INVENTION

A card edge connector of the present invention comprises an insulative housing having a body and opposed perpendicular arms. There is a card receiving side having a longitudinal groove and an opposed side on the body. The groove has opposed lateral first and second sides. These first and second sides have at least one first and second contact receiving opening and there is at least one recess in the card receiving side of the body communicating with said first opening. There is also at least one recess in the opposed side of the body communicating with the second opening. A first contact is fixed in the recess in the card receiving side of the body and extends through said first opening into the groove. A second contact is fixed in the recess in said opposed side of the body and extends through said second opening into the groove. Both of the contacts have a body with a projection that engages an axial groove in their respective recesses to fix them in those recesses. The first contact has a resilient arm which first extends from the body toward the opposed side and then extends back toward the card receiving side of the body to pass through the opening in the lateral wall of the groove where it has curved around the terminal end and engages the card. The second contact also has a resilient arm which has a first section which extends back toward the opposed side of the housing and then extends toward the card receiving side of the housing to pass through an opening in the opposed lateral wall where it also has a rounded terminal end that contacts the card. By means of this construction, the contacts may be securely fixed in the housing and the card may be efficiently engaged with the contacts.

Another feature of the card edge connector of the present invention is metal inserts which are positioned on the housing adjacent the perpendicular arms. These inserts protect the housing against overstress, provide a stop for the card, provide a solderable hold down and simplify the overall tooling for the edge connector.

BRIEF DESCRIPTION OF THE DRAWINGS

The card edge connector of the present invention is further described with reference to the accompanying drawings in which.

DETAILED DESCRIPTION OF THE PREFERRED EMBODIMENTS

Figure 1:
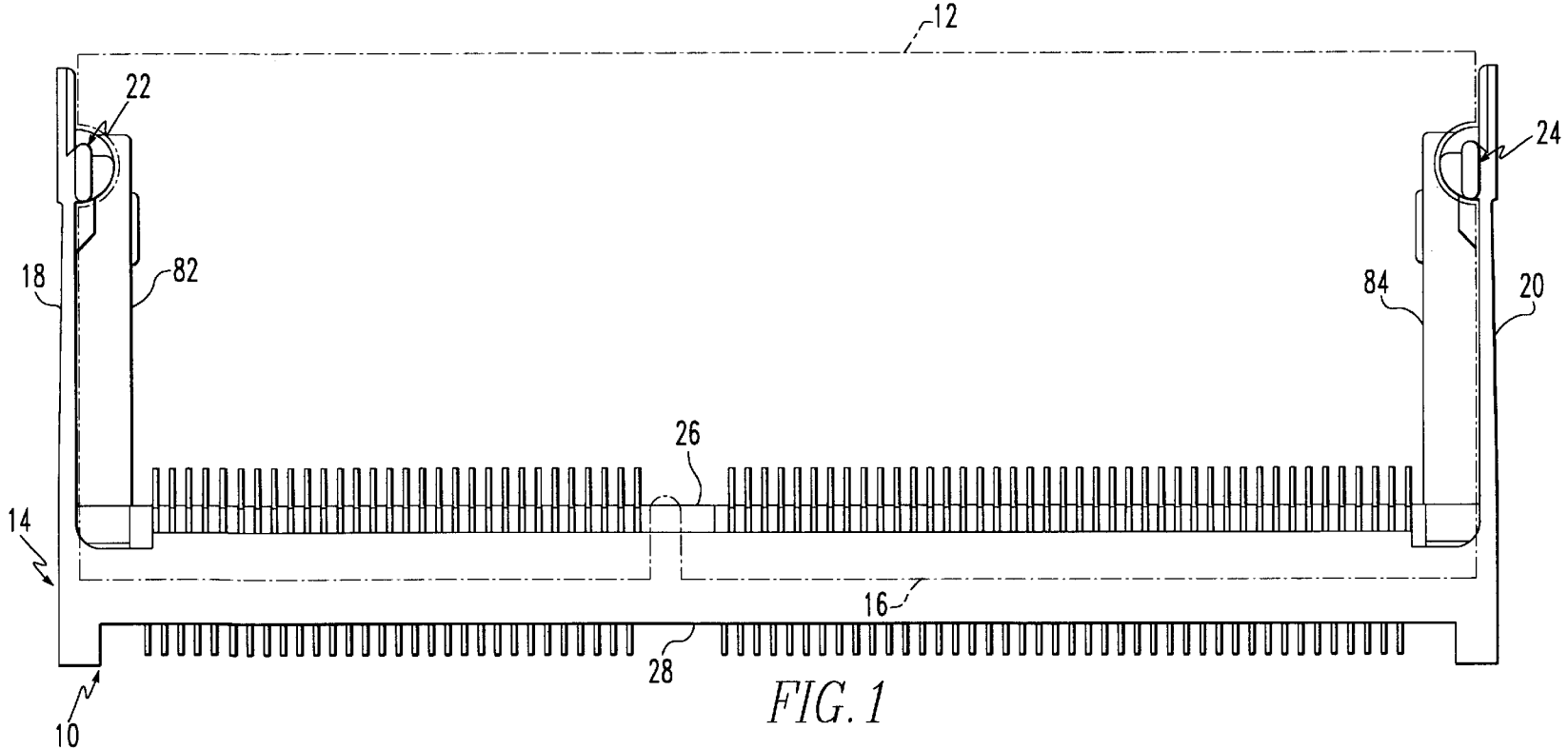
FIG. 1 is a front elevational view of a DIMM socket which represents a preferred embodiment of the card edge connector of the present invention.
Figure 5:
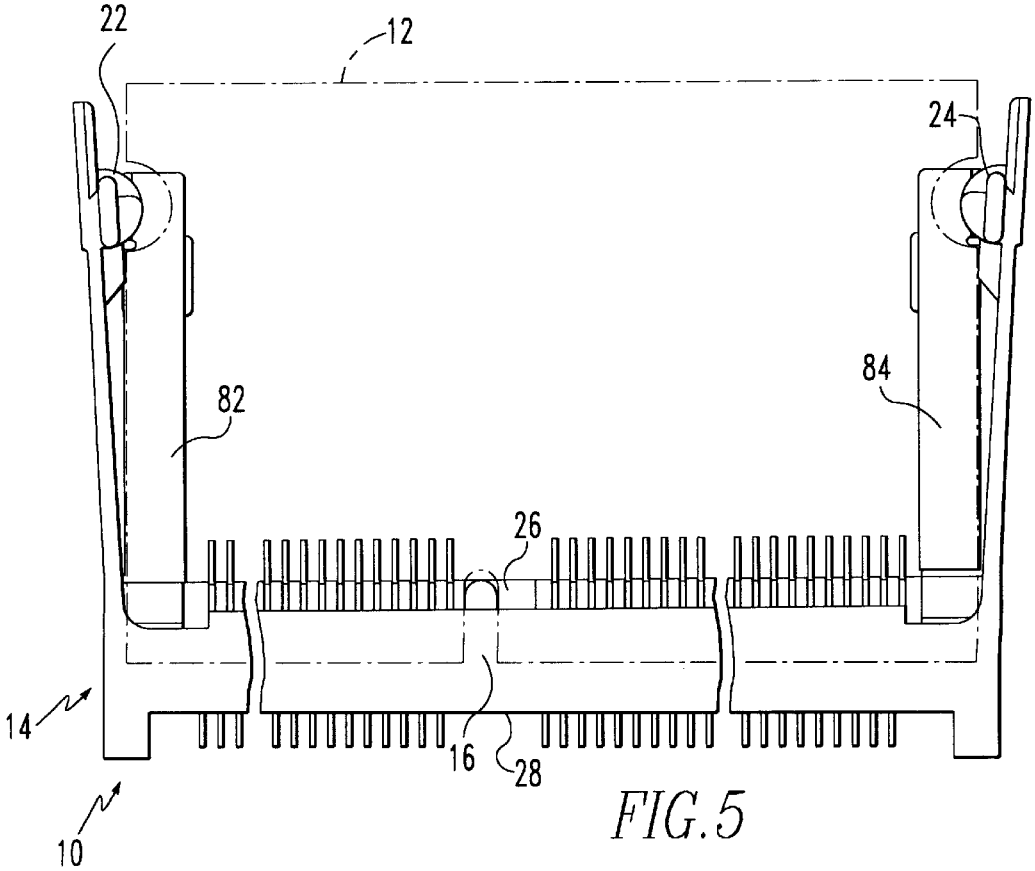
FIG. 5 is a cutaway front elevational view of the DIMM socket shown in FIG. 1 prior to engagement to the card.
Figure 6:
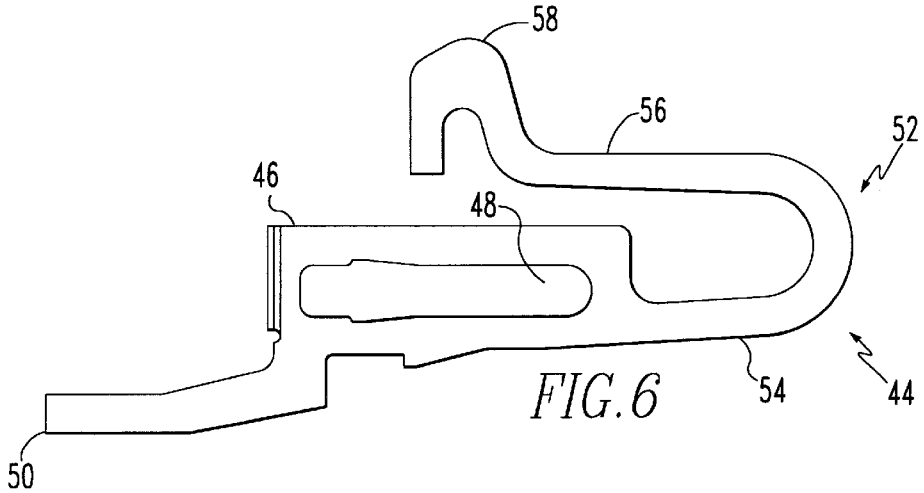
FIG. 6 is a top plan view of the contact used in the DIMM socket shown in FIG. 1.
Figure 7:
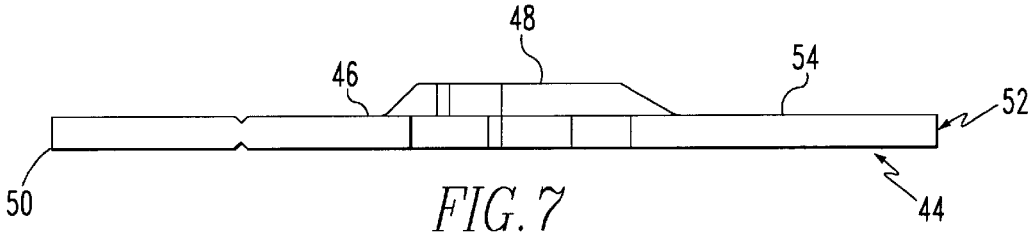
FIG. 7 is an end view of the contact shown in FIG. 5.
Figure 8:
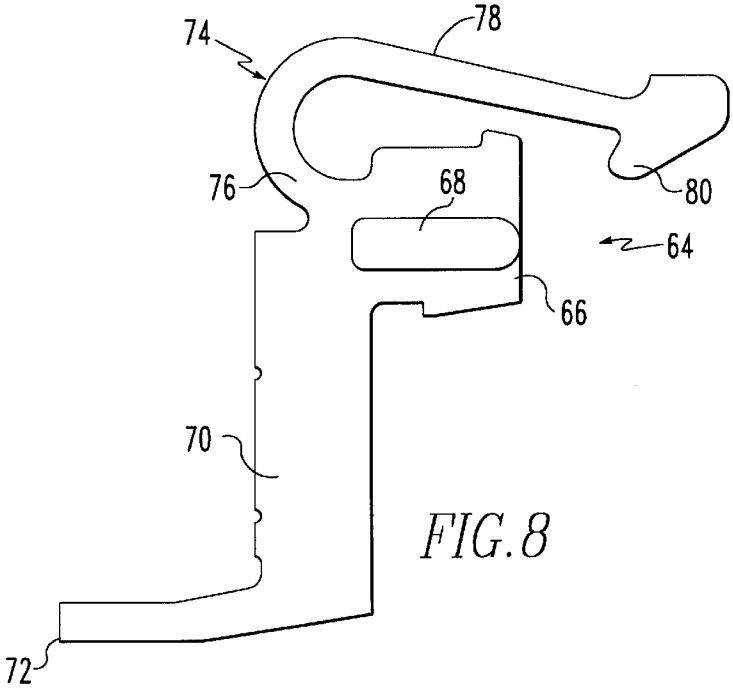
FIG. 8 is a top plan view of another contact used in the DIMM socket shown in FIG. 1.
Figure 9:
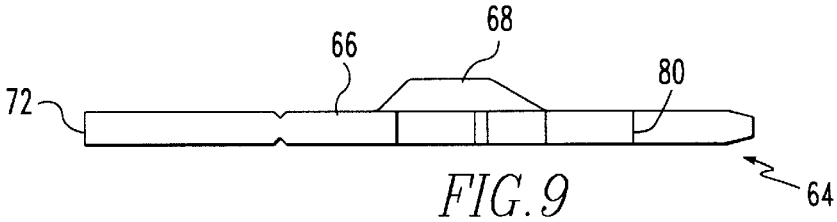
FIG. 9 is an end view of the contact shown in FIG. 7.
Figure 10A:
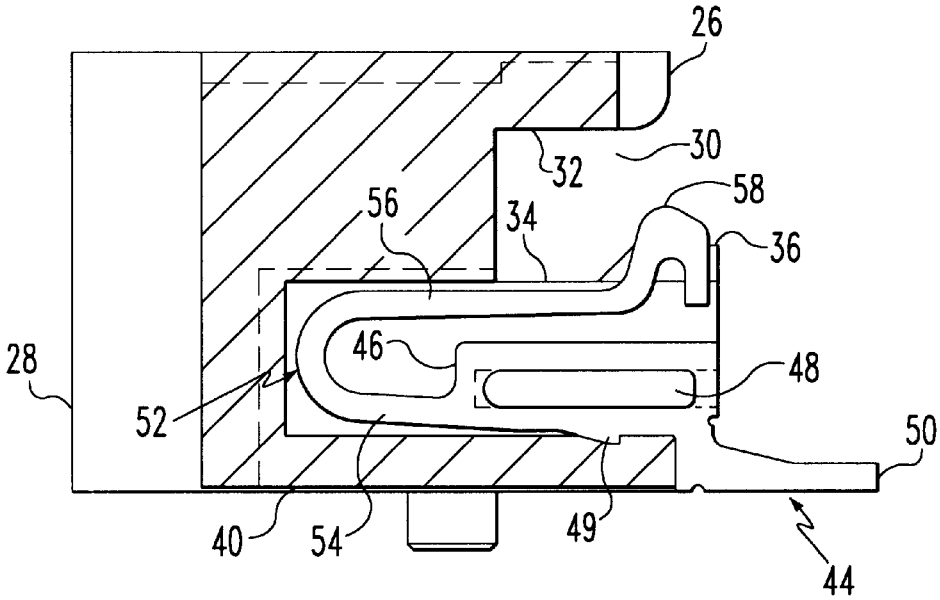
FIG. 10*a* is a cross sectional view through X—X in FIG. 3 showing the mounting of the contact shown in FIGS. 5–6.
Figure 10B:
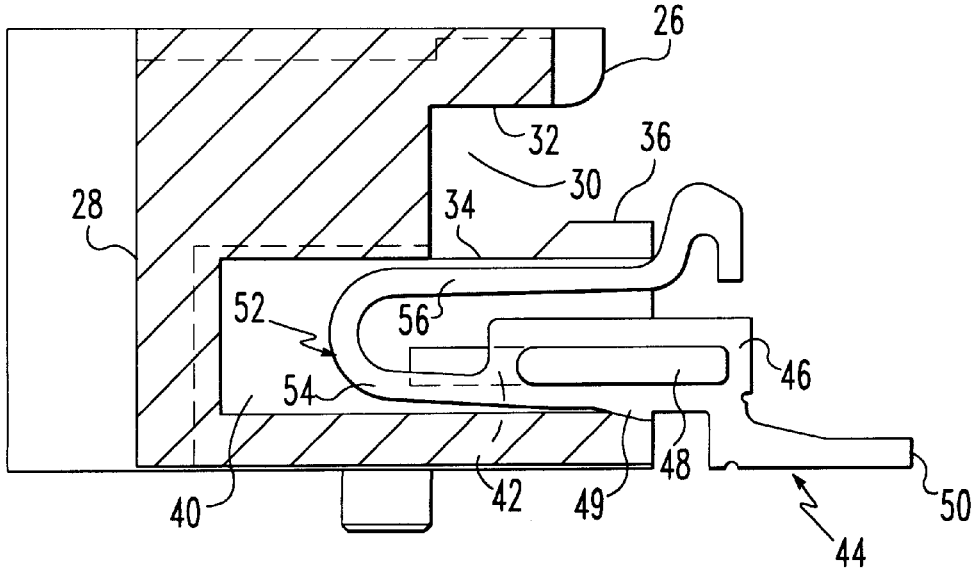
FIG. 10*b* is a view similar to FIG. 9*a* showing the initial insertion of the contact prior to mounting as is shown in FIG. 9*a;*

Referring to FIGS. 1–5, the DIMM socket of the present invention is shown generally at numeral 10. In FIGS. 1 and 5 a card held by this socket is shown in phantom lines at numeral 12. The DIMM socket includes an insulated housing shown generally at numeral 14 which is comprised of a main body 16 and two opposed perpendicular arms 18 and 20. On each of these arms there is a card engagement axial projections shown respectively at numerals 22 and 24 generally for engagement of the card. The body of the insulating housing includes a card receiving side 26 and an opposed side 28.

Figure 11A:
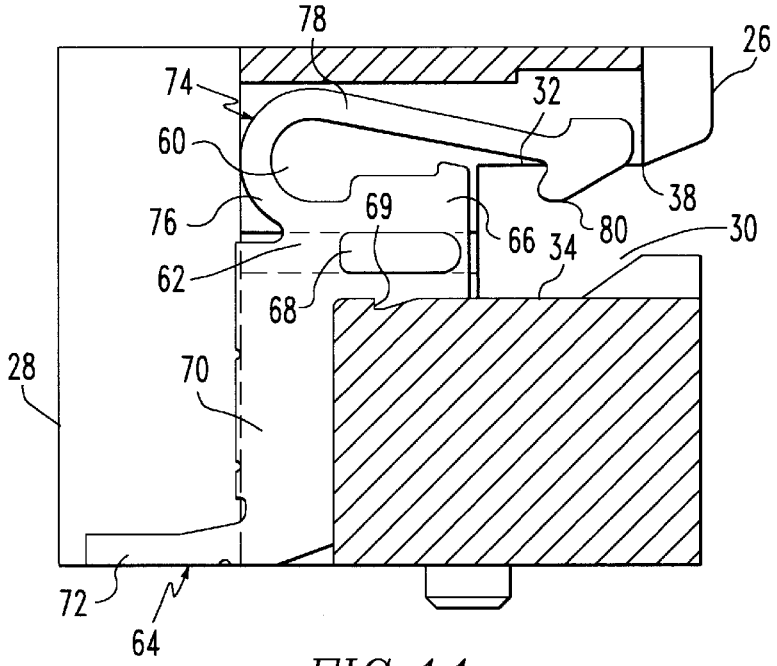
FIG. 11*a* is a cross sectional view through X—X in FIG. 2 showing the mounting of the contact shown in FIGS. 7–8.
Figure 11B:
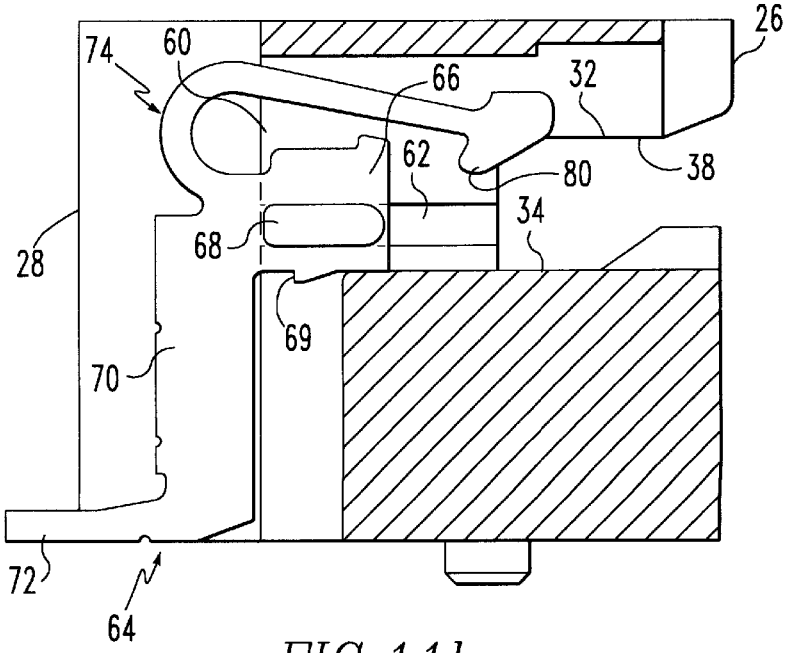
FIG. 11*b* is a view similar to FIG. 10*a* showing the initial insertion of the contact prior to mounting as is shown in Fig. 10*a;*

Referring particularly to FIGS. 10*a*–10*b* and FIGS. 5–6, there is on the card receiving side of the housing a longitudinal groove 30 which engages the lower end of the card 12. This longitudinal groove has opposed lateral wall 32 and 34 which have, respectively, openings 36 and 38 (FIGS. 11*a*–11*b*). There is also a transverse recess in the card receiving side 40 which is in communication through the opening or groove 36 with the longitudinal groove 30. In this recess there is an axial groove 42. Recess 40 receives, a first contact shown generally at numeral 44. This first contact includes a body 46 with a projection 48 that engages groove 42 to fix this contact in recess 40. This contact also includes a lead 50 and a resilient arm shown generally at numeral 52. The resilient arm 52 includes a downward extension 54, an upward extension 56 and a curved or rounded terminal end 58 which extends into the longitudinal groove 30. The terminal end 58 of resilient arm 52 is compressible toward the contact body 46 to allow a card edge to be inserted into groove 30.

Referring particularly to FIGS. 11*a*–11*b* and FIGS. 8–9, there is also a transverse recess 60 in the opposed side of the body 16 of the insulated housing 14. This recess also has an axial groove 62. A second contact shown generally at numeral 64 is positioned in this recess 60. This second contact includes a body 66 with a projection 68 that engages groove 62 in recess 60 to fix the second contact in this recess. This second contact also includes a base 70 from which a lead 72 depends. The second contact also includes a resilient arm shown generally at numeral 74 which includes a downward extension 76, an upward extension 78 and a rounded terminal end 80 which extends into the longitudinal groove. The terminal end 80 of resilient arm 64 is compressible away from contact body 66 to allow a card edge to be inserted into groove 30.

Referring particularly to FIGS. 10 and 11, it will be seen that the first and second contacts are respectively initially mounted in their recesses on the card receiving side and the opposed side. They are then fixed in these recesses by the application of further axial force on them from their initial positions.

Figure 12:
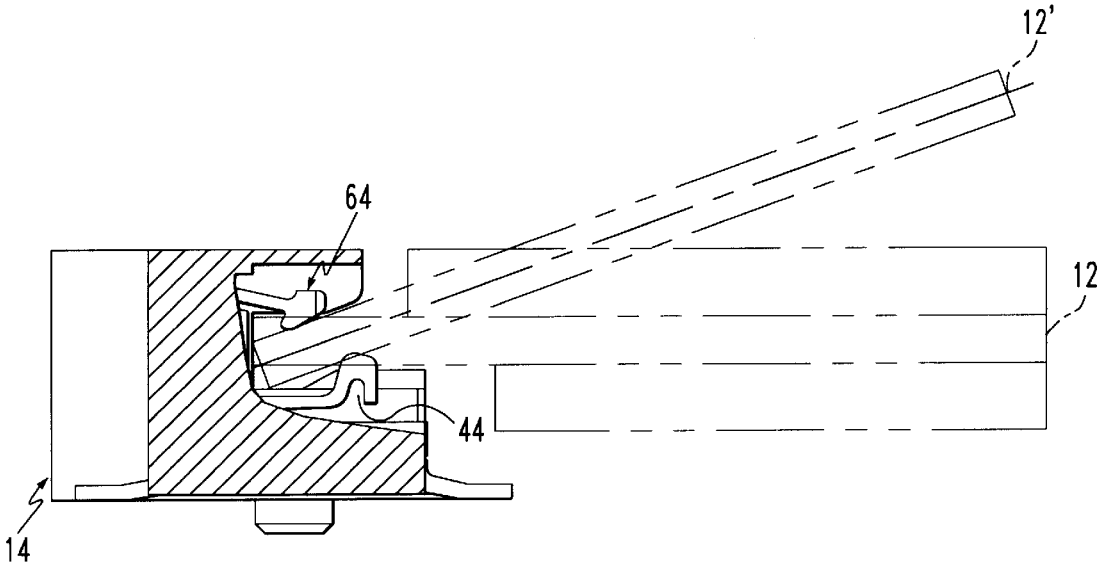
FIG. 12 is a schematic cross sectional view of the DIMM socket shown in FIG. 1 illustrating the insertion of the card.
Figure 16:
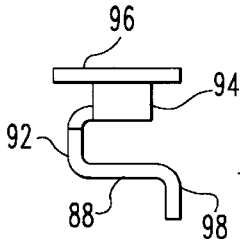
FIG. 16 is a top plan view of the metallic insert shown in FIG. 13.
Figure 13:
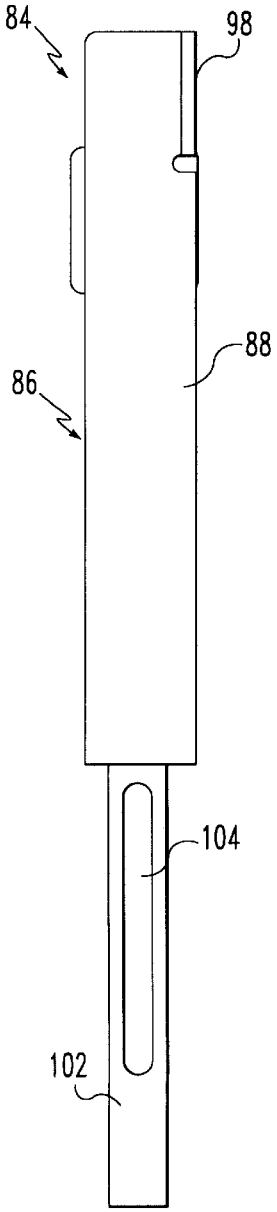
FIG. 13 is a front elevational view of one of the entire metallic insert supports shown in FIGS. 1–2, 4 and 12.
Figure 14:
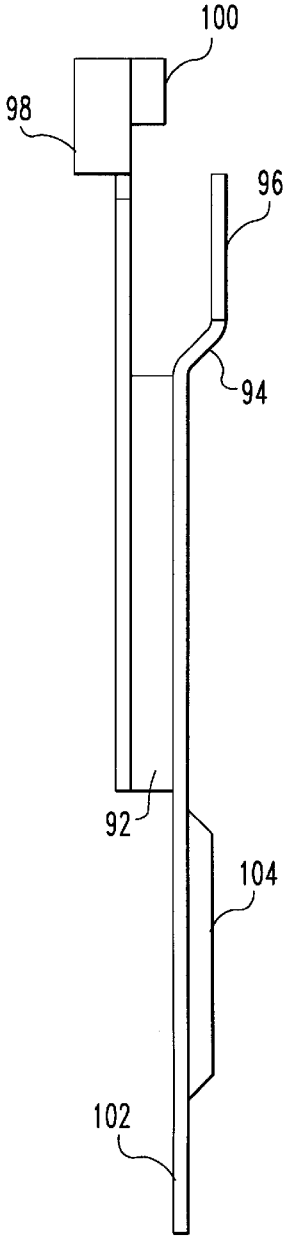
FIG. 14 is a side elevational view of the metallic insert shown in FIG. 13.
Figure 15:
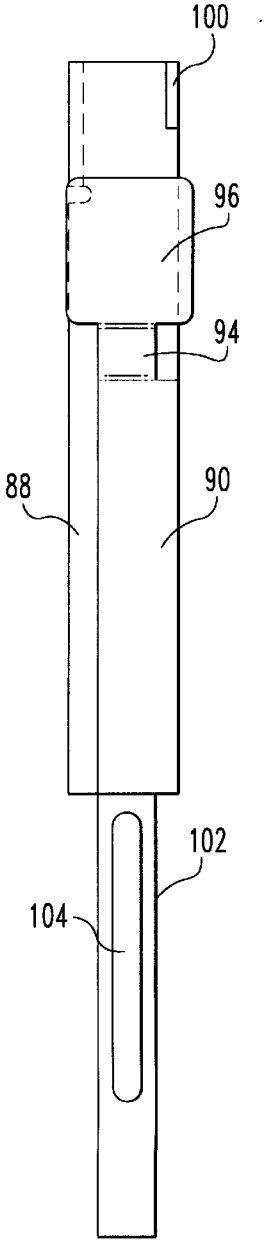
FIG. 15 is a rear elevational view of the metallic insert shown in FIG. 13.

Referring particularly to FIG. 12, it will be seen that the rounded terminal ends of contacts 44 and 66 are horizontally and vertically spaced from each other so that the card may initially be inserted between them at an angular position as at 12. The card may then be pivoted on the rounded terminal ends of contacts to be fixed into its final position as at 12.

It will be appreciated that a means for efficiently and economically mounting the contacts in the insulative housing of the card edge connector has been described. It will also be appreciated that an efficient and economical means for engaging the card with the contacts has also been provided.

Figure 3:
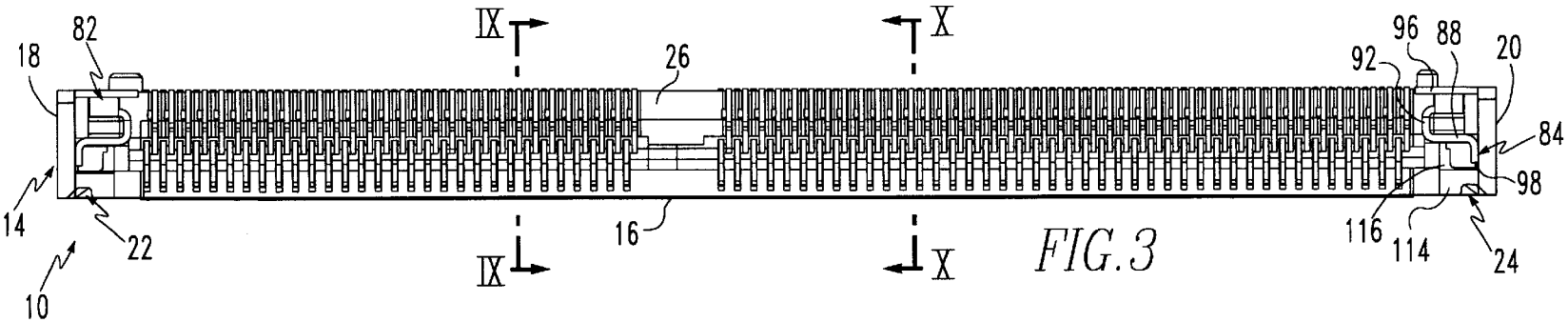
FIG. 3 is a top plan view of the DIMM socket shown in FIG. 1.
Figure 2:
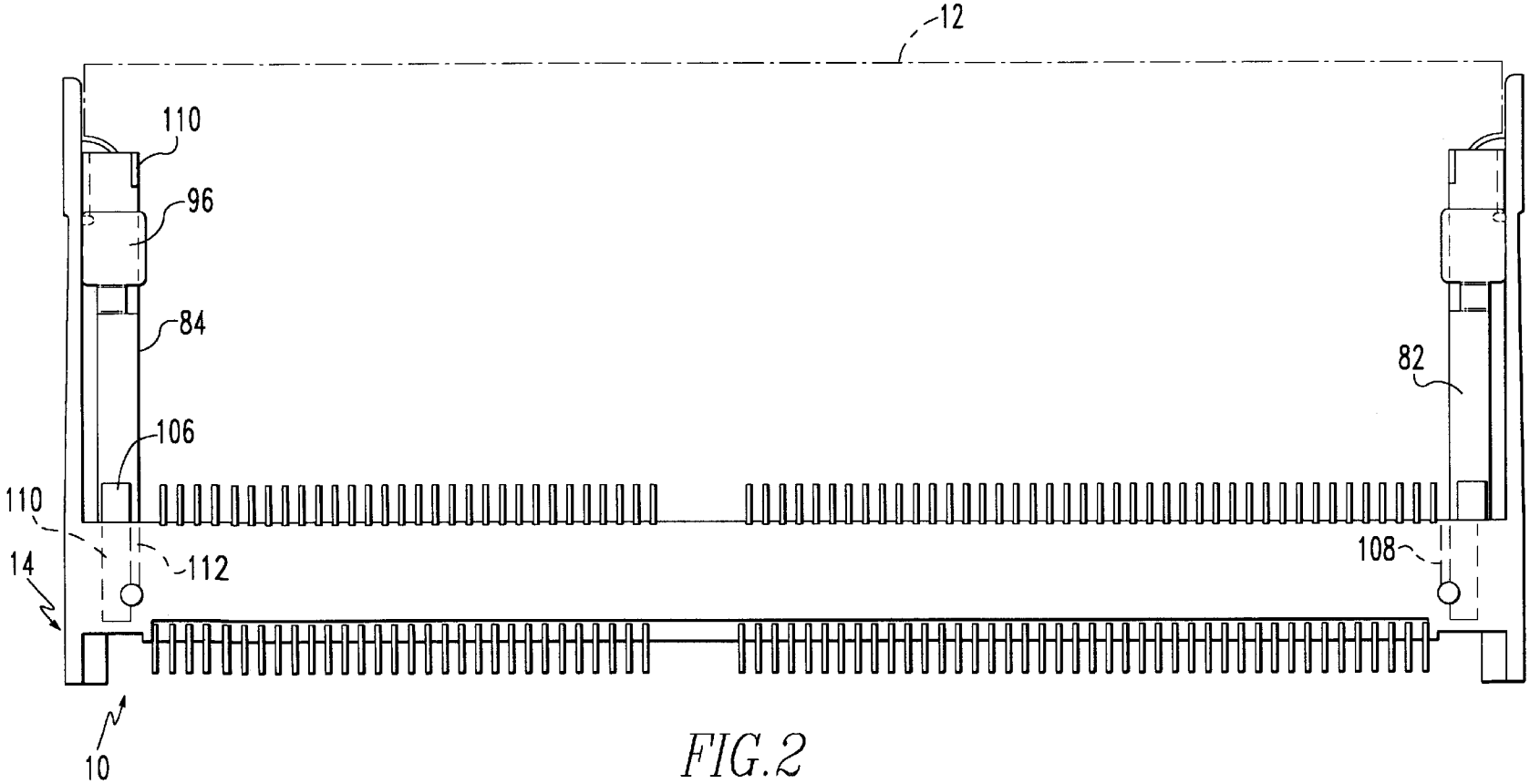
FIG. 2 is a rear elevational view of the DIMM socket shown in FIG. 1.
Figure 4:
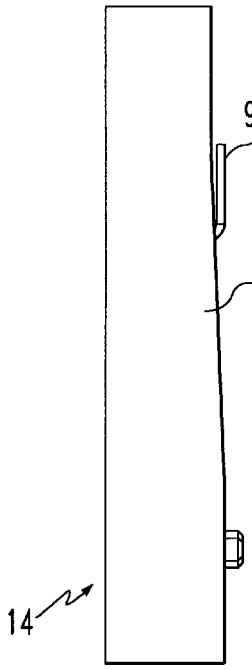
FIG. 4 is an end view of the DIMM socket shown in FIG. 1.

Referring particularly to FIGS. 1–5 and FIGS. 13–16 it will be seen that another feature of the present invention comprises metal inserts 82 and 84 which project upwardly from the body of the housing. Referring particularly to FIGS. 1–2 and 13–16, will be seen that the metal insert 84 includes a main body section shown generally at numeral 86 which is comprised of a front panel 88, a rear panel 90 and a transverse section 92 which connects said front and rear panels. Extending upwardly and rearwardly from the rear panel 90 there is a resilient diagonal arm 94 which connects to a resilient tab 96. On the front panel 88 there is a front transverse spacing tang 98 and a rear transverse spacing tang 100. Extending downwardly from the main body section there is a lower depending leg 102 with a longitudinal rib 104 which is mounted in a vertical projection 106 (FIG. 2) on the card receiving side of the insulated housing. This mounting is accomplished by engaging the lower depending leg 106 of the metal insert with a vertical slot 108 which extends downwardly through the vertical projection and into the insulating housing. It insulated housing. This mounting is accomplished by engaging the lower depending leg 106 of the metal insert with a vertical slot 108 which extends downwardly through the vertical projection and into the insulating housing. It will be understood that metal insert 84, 15 similarly mounted by engaging projection 110 in slot 112 (FIG. 2). The card engagement axial projections also include longitudinal mounting member as at 114 (FIG. 3) and a transverse leg as at 116 (FIG. 3). These metal inserts function as an overstress protector for the plastic latch, a stop for the daughter board, and a solderable hold-down. That is, overstress is prevented by interaction of tang 98 with mounting member 114 and with leg 116. Under stress, tang 98 may abut against mounting member 114 and leg 116 may abut against front panel 88 of the metal insert 84. The tooling for the plastic housing can be simplified by the use of these metal inserts. Further these metal inserts achieve these results as a simple one piece part.

While the present invention has been described in connection with the preferred embodiments of the various figures, it is to be understood that other similar embodiments may be used or modifications and additions, may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A card edge connector comprising an insulative housing comprising a body and opposed perpendicular arms and there being a card receiving side having a longitudinal groove and an opposed side on the body and said groove having opposed lateral first and second sides and said first and second sides having, respectively, at least one first and second contact receiving opening and there being at least one recess in the card receiving side of the body communicating with said first opening in the first lateral side of the longitudinal groove and at least one recess in the opposed side of the body communicating with the second opening in the second lateral side of the groove and a first contact is positioned in the recess in the card receiving side of the body and extends through said first opening into the groove and a second contact fixed in the recess in said opposed side of the body and extending through said second opening into the groove, and there is a metal insert inwardly adjacent each of said perpendicular arm for providing stress protection and said metal inserts are mounted in slots in the body of the housing on its card receiving side.

2. The card edge connector of claim 1 wherein the first contact has a body fixed in the recess in the card receiving side and an arm which extends first into said recess toward the opposed side of the body and then toward the card receiving side and then through the first opening into the groove.

3. The card edge connector of claim 1 wherein the second contact has a body fixed in the recess in the opposed side of the body and an arm extends first toward the opposed side and then toward the card receiving side and then through the second opening into the groove.

4. The card edge connector of claim 2 wherein there is an axial groove in the recess and a projection from the body engages said groove.

5. The card edge connector of claim 2 wherein the arm of the first contact has a terminal end which extends into the first opening and in which is rounded.

6. The card edge connector of claim 5 wherein the arm is resilient.

7. The card edge connector of claim 6 wherein the arm is compressible toward the body of the contact.

8. The card edge connector of claim 2 wherein the first opening is a transverse groove between the longitudinal groove and the recess.

9. The card edge connector of claim 2 wherein the recess in the card receiving side of the body is transverse.

10. The card edge connector of claim 3 wherein there is an axial groove in the recess in the opposed side of the body and a projection in the body of the second contact engages said groove.

11. The card edge connector of claim 2 wherein the arm of the second contact has a terminal end which extends through the first opening into the groove and said terminal end is rounded.

12. The card edge connector of claim 3 wherein the arm of the second contact is resilient.

13. The card edge connector of claim 12 wherein the arm of the second contact is compressible away from the body of the second contact.

14. The card edge connector of claim 2 wherein the second opening is a transverse groove between the longitudinal groove and the recess, in the opposed side of the housing.

15. The card edge connector of claim 3 wherein the recess in the opposed side of the housing is transverse.

16. The card edge connector of claim 2 wherein the groove is superimposed over at least part of the recess in the opposed side of the body.

17. The card edge connector of claim 1 wherein the contacts have terminal ends and said terminal ends are rounded and are spaced from each other to allow a card to be angularly inserted into the longitudinal groove and then pivoted to a position generally coplanar with said groove.

18. A method of mounting a card in an edge connector comprising a housing having a body with a card receiving side having a longitudinal groove and an opposed side and opposed arms projecting perpendicularly from said body comprising the steps of positioning a first conductive contact having a rounded terminal end and a second conductive contact having a rounded terminal end adjacent said longitudinal groove such that said rounded terminal ends are horizontally and vertically spaced from each other, then inserting the card between said rounded terminal ends in a position angularly disposed to the longitudinal groove, and then pivoting the card to a position generally coplanar with the groove, and providing metal inserts fixed to the body of the insulative housing inwardly adjacent to the opposed arms projecting perpendicularly from said body to provide a stop means for the card and an overstress protection means for said arms.

19. The method of claim 18 wherein the first conductive contact is inserted in a transverse recess in the card receiving side of the body and the second conductive contact is inserted in a transverse recess in the opposed side of the body.

* * * * *